US007086473B1

(12) United States Patent
Bangash

(10) Patent No.: US 7,086,473 B1
(45) Date of Patent: Aug. 8, 2006

(54) SUBMERSIBLE PUMPING SYSTEM WITH SEALING DEVICE

(75) Inventor: Yasser Khan Bangash, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 308 days.

(21) Appl. No.: 10/234,793

(22) Filed: Sep. 3, 2002

Related U.S. Application Data

(60) Provisional application No. 60/322,327, filed on Sep. 14, 2001.

(51) Int. Cl.
*E21B 43/00* (2006.01)

(52) U.S. Cl. ..... 166/372; 166/68; 166/386; 417/423.3

(58) Field of Classification Search ..... 166/369, 166/370, 372, 381, 386, 68, 105; 417/423.1, 417/423.15, 423.3, 423.9
See application file for complete search history.

(56) References Cited

U.S. PATENT DOCUMENTS 4,293,288 A * 10/1981 Weber ..... 417/434
4,498,543 A * 2/1985 Pye et al. ..... 166/376
4,528,131 A * 7/1985 Kardos et al. ..... 424/570
4,615,389 A * 10/1986 Neely et al. ..... 166/250.01
4,632,647 A * 12/1986 Rowlett ..... 417/498
4,913,630 A * 4/1990 Cotherman et al. ..... 417/313
4,932,474 A * 6/1990 Schroeder et al. ..... 166/278
5,097,914 A * 3/1992 Grotendorst ..... 175/59
5,320,178 A * 6/1994 Cornette ..... 175/19
5,355,956 A * 10/1994 Restarick ..... 166/296
5,419,394 A * 5/1995 Jones ..... 166/51
5,472,054 A * 12/1995 Hinds ..... 166/373
5,526,881 A * 6/1996 Martin et al. ..... 166/296
5,662,167 A * 9/1997 Patterson et al. ..... 166/265
6,068,053 A * 5/2000 Shaw ..... 166/267
6,082,452 A * 7/2000 Shaw et al. ..... 166/105.5
6,085,837 A * 7/2000 Massinon et al. ..... 166/265
6,089,832 A * 7/2000 Patterson ..... 417/360
6,120,261 A * 9/2000 Al-Towailib ..... 417/356
6,138,758 A * 10/2000 Shaw et al. ..... 166/265
6,201,327 B1 * 3/2001 Rivas ..... 310/87
6,216,788 B1 * 4/2001 Wilson ..... 166/311
6,220,823 B1 * 4/2001 Newcomer ..... 417/118
6,237,688 B1 * 5/2001 Burleson et al. ..... 166/281
6,361,272 B1 * 3/2002 Bassett ..... 415/121.1
6,397,950 B1 * 6/2002 Streich et al. ..... 166/376
6,508,308 B1 * 1/2003 Shaw ..... 166/313
6,595,295 B1 * 7/2003 Berry et al. ..... 166/369
6,772,837 B1 * 8/2004 Dusterhoft et al. ..... 166/278
6,857,476 B1 * 2/2005 Richards ..... 166/278
6,994,338 B1 * 2/2006 Lehmann ..... 166/105
2003/0075324 A1 * 4/2003 Dusterhoft et al. ..... 166/279

* cited by examiner

*Primary Examiner*—Jennifer H. Gay
(74) *Attorney, Agent, or Firm*—Crowe & Dunlevy, P.C.

(57) ABSTRACT

A submersible pumping system includes a pump assembly that is connected to a motor assembly. The pump assembly includes a pump intake having an intake hole, a pump housing connected to the pump intake and a pump discharge head connected to the pump housing. An intake seal device is connected to the pump intake and seals the pump intake prior to the initial use of the pump assembly. To further isolate the pump assembly while dormant, an outlet seal device can be fitted to the pump discharge head to isolate the pump assembly from the reservoir fluid in the production tubing.

20 Claims, 4 Drawing Sheets

SUBMERSIBLE PUMPING SYSTEM WITH SEALING DEVICE

RELATED APPLICATIONS

This application claims priority to U.S. Provisional Patent Application No. 60/322,237 entitled "Electric submersible pumping system With Sealing Device," filed Sep. 14, 2001, which is incorporated herein by reference.

FIELD OF THE INVENTION

The present invention relates generally to the field of submersible pumping systems. The present invention more particularly relates to a submersible pumping system that is configured to remain sealed in a dormant state until needed.

BACKGROUND OF THE INVENTION

Submersible pumping systems are frequently used to recover petroleum fluids from subterranean reservoirs through a well. In most cases, submersible pumping systems are used to achieve secondary recovery by providing artificial lift when reservoir pressures have declined to a level where unassisted production rates are not viable.

Traditionally, the submersible pumping system is installed in a well by a workover operation. A workover operation involves controlling the fluid in the wellbore by suitable means and installing the electrical submersible pump system at a suitable depth with the help of production tubing. The equipment, labor and downtime required by workover operations can be cost-prohibitive, especially in remote locations and in offshore wells.

In light of the prohibitive expenses of performing retrofit or workover operations, there is a need for an improved economical method of achieving secondary production through use of a submersible pumping system. It is to these and other deficiencies in the prior art that the present invention is directed.

SUMMARY OF THE INVENTION

The present invention provides an electrical submersible pumping system that includes a pump assembly that is connected to a motor assembly. The pump assembly includes a pump intake having at least one intake hole, a pump housing connected to the pump intake and a pump discharge head connected to the pump housing. An intake seal device is connected to the pump intake and seals the pump intake prior to the initial use of the pump assembly. To further isolate the pump assembly while dormant, an outlet seal device can be fitted to the pump discharge head to isolate the pump assembly from fluid and debris in the production tubing. The intake and outlet seal devices are configured for removal.

These and other features and advantages which characterize the present invention will be apparent from a reading of the following detailed description and a review of the associated drawings.

DETAILED DESCRIPTION OF THE PREFERRED EMBODIMENT

To avoid the expense of retrofitting a well through a workover operation, it is desirable to "pre-equip" a well with a downhole pumping system during the initial completion stages of the well. Ideally, the installed downhole pumping system would remain dormant until secondary recovery is necessary.

There are a number of factors, however, that complicate the installation of a dormant downhole pumping system. For example, the period of primary recovery could extend for years, thereby subjecting the downhole pumping system to prolonged exposure to the corrosive wellbore environment. Additionally, scale, debris and paraffin may accumulate and corrode the components of the downhole pumping system, causing failure or decreased operational efficiency. It is therefore necessary to protect the internal components of the downhole pumping system while in the dormant state.

Figure 1:
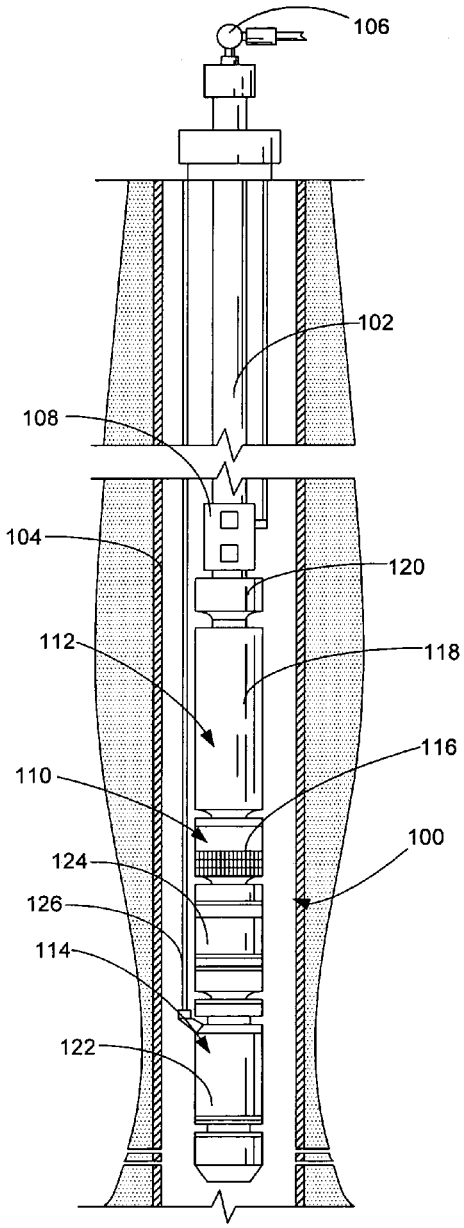
FIG. 1 is an elevational view of a preferred embodiment of an electric submersible pump system of the present invention.

Referring to FIG. 1, shown therein is a equipment string 100 attached to production tubing 102. The equipment string 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the equipment string 100 to a wellhead 106 located on the surface.

The equipment string 100 includes a sliding sleeve 108 and an electric submersible pumping system 110. Although an electric submersible pumping system 110 is presently preferred, it will be understood that the present invention can be successfully implemented with other downhole pumping systems, such as gas-powered pump assemblies. It will also be understood that additional elements or components not disclosed herein can be included in the equipment string 100, such as gas separators.

The sliding sleeve 108 is a device that is commonly used in the industry to provide a flow path between the production tubing and the annulus of the wellbore 104. The sliding sleeve 108 preferably incorporates a system of ports that can be opened or closed by either mechanical or hydraulic means. Suitable sliding sleeves 108 are available from Baker Hughes or Weatherford International, both of Houston, Tex.

The electric submersible pumping system 110 preferably includes a pump assembly 112 and a motor assembly 114. The pump assembly 112 includes a pump intake 116 attached to the base of a pump housing 118. A pump discharge head 120 is attached to the opposite end of the pump housing 118. Preferably, the pump assembly 112 is a multi-stage centrifugal pump that employs a plurality of impellers within the pump housing 118. It will be noted, however, that other types of pumps, such as positive displacement pumps, can also be used with the present invention.

The pump assembly 112 is driven by the motor assembly 114. The motor assembly 114 includes an electric motor 122 that is coupled to a seal section 124. Alternatively, the motor 122 can be attached to a motor protector alone or in combination with the seal section 124. Power is provided to the motor 122 through a power cable 126. Preferably, the motor is oil-filled and includes an elongated stator that encompasses a series of rotors and bearings disposed about a central shaft. Such motors and seals are known in the industry and are available from the Wood Group ESP, Inc., Oklahoma City, Okla.

Figure 2:
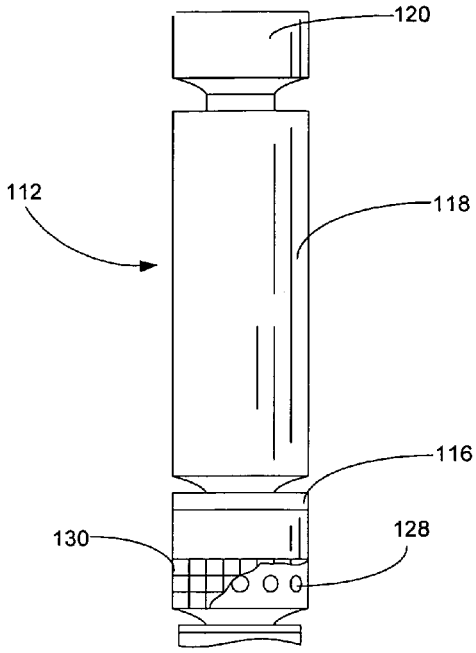
FIG. 2 is an elevational view of the pump assembly of the submersible pump system of FIG. 1.

Turning to FIG. 2, shown therein is the pump assembly 112. The pump intake 116 includes a plurality of intake holes 128 disposed about the circumference of the pump intake 116. During operation, fluid is drawn into to the pump intake 116 through the intake holes 128. To discourage the introduction of particulate matter into the pump intake 116, a filter or screen 130, shown in partial cutaway, can be used to cover the intake holes 128. While dormant, the pump assembly is preferably filled with a working fluid, such as a non-corrosive hydraulic fluid. If mechanical shock is anticipated at startup, a highly viscous working fluid may be preferred.

Figure 3:
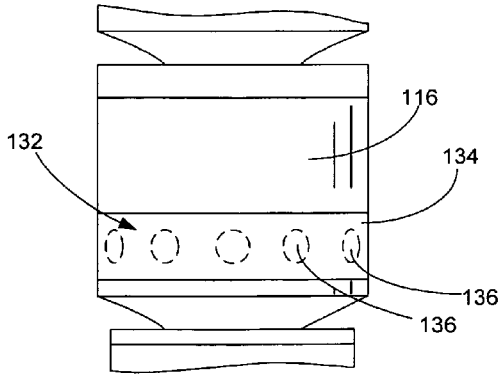
FIG. 3 is an elevational view of the intake of the pump assembly of FIG. 2 with a first embodiment of the intake seal device.

Referring to FIG. 3, shown therein is the pump intake 116 and a first intake seal device 132 constructed in accordance with a preferred embodiment of the present invention. The first intake seal device 132 includes a cylindrical band 134 that is tightly fitted around the pump intake 116. A plurality of rupture discs 136 are integrated into the cylindrical band 134. Preferably, each of the rupture discs 136 is larger than the area of the intake holes 128 and positioned directly over a corresponding intake hole 128 to seal the pump intake 116 from the wellbore 104 environment.

The rupture discs 136 can be discrete pieces or perforated shapes on the cylindrical band 134. Preferably, the first intake seal device 132 is fabricated from a corrosion-resistant metal alloy, such as aluminum or treated steel, and calibrated to separate from the cylindrical band 134 at a predefined "rupture pressure." When the internal pressure of the pump intake 116 exceeds the predefined rupture pressure, the rupture discs 136 become partially or fully dislodged from the cylindrical band 134, thereby placing the pump assembly 112 in fluid communication with the wellbore 104.

Figure 4:
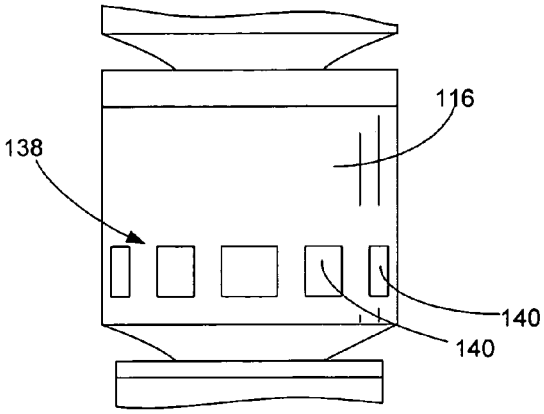
FIG. 4 is an elevational view of the intake of the pump assembly of FIG. 2 with a second embodiment of the intake seal device.

FIG. 4 shows a second intake seal device 138 constructed in accordance with another preferred embodiment of the present invention. The second intake seal device 138 includes a plurality of discrete rupture plates 140 that cover and seal the intake holes 128. Preferably, the rupture plates 140 are constructed from a corrosion-resistant material such as aluminum, glass or ceramic that exhibits favorable fracture characteristics. The rupture plates 140 are preferably calibrated during manufacture to separate from the pump intake 116 or shatter when exposed to a preset rupture pressure from within the pump assembly 112.

Figure 6:
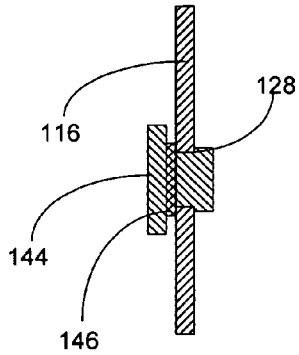
FIG. 6 is a side cross-sectional view of the intake of the pump assembly and the intake seal device of FIG. 5.
Figure 5:
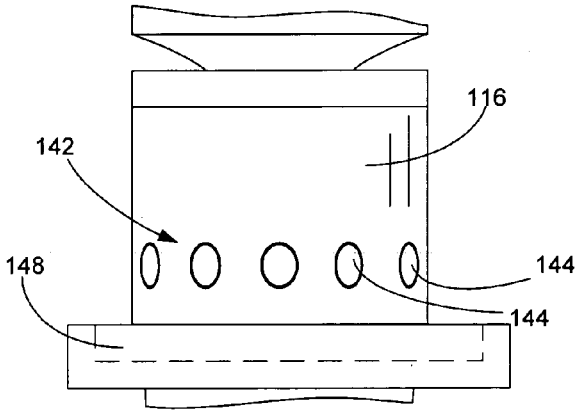
FIG. 5 is an elevational view of the intake of the pump assembly of FIG. 2 with a third embodiment of the intake seal device and a catch collar.

Referring to FIGS. 5 and 6, shown therein is a third intake seal device 142 constructed in accordance with yet another preferred embodiment of the present invention. The third intake seal device 142 includes a plurality of stoppers 144 that are configured to fit tightly within the intake holes 128. Preferably, the stoppers 144 include a degradation-resistant elastomer that is capable of forming a fluid-tight seal within the intake holes 128.

An external washer 146 can be used in conjunction with each of the stoppers 144 to provide an additional protective seal around each of the intake holes 128. The third intake seal device 142 is calibrated during construction and installation to dislodge from the pump intake 116 when the pressure gradient across the third intake seal device 142 reaches the predefined rupture pressure.

Also shown in FIG. 5 is a catch collar 148. The catch collar 148 is positioned at the bottom of the pump intake 116 and configured to catch the stoppers 144 when dislodged from the intake holes 128. Catching the stoppers 144 as they are dislodged reduces the risk that the stoppers 144 will be drawn back into pump intake 116, thereby interrupting the inlet flow. It will be understood that the catch collar 148 can be implemented with any one of the intake seal devices disclosed herein.

Figure 7:
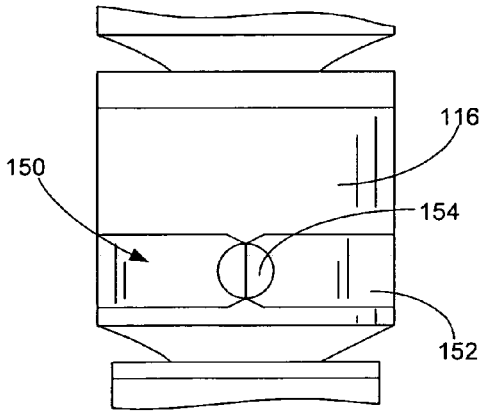
FIG. 7 is an elevational view of the intake of the pump assembly of FIG. 2 with a fourth embodiment of the intake seal device.

Referring to FIG. 7, shown therein is a fourth intake seal device 150 constructed in accordance with yet another preferred embodiment of the present invention. The fourth intake seal device 148 includes a belt seal 152 that is wrapped around the intake holes 128 and held together by a buckle disc 154. Alternatively, the buckle disc 154 can be formed by perforations or scoring in the rectangular band 152. In this alternative construction, the fourth intake seal device is manufactured as a unitary piece. Again, it is preferred that the belt seal 152 and buckle disc 154 be fabricated from a corrosion-resistant material, such as aluminum, stainless steel or degradation-resistant elastomeric compounds.

The buckle disc 154 is preferably positioned directly over one of the intake holes 128 and configured to rupture under a predefined rupture pressure. When the buckle disc 154 ruptures, the belt seal 152 separates and falls away from the pump intake 116, thereby revealing all of the intake holes 128.

In some applications, the fourth intake seal device 150 may be preferred over the first, second and third intake seal devices 132, 138 and 142, respectively. Each of the first, second and third intake seal devices 132, 138 and 142 relies on independent rupture discs, plates or stoppers to seal the intake holes 128. As described above, to open the intake holes, the internal pressure of the pump intake 116 must be elevated above the predefined rupture point. In theory, when the predefined rupture pressure has been reached, all of the independent discs, plates or stoppers would simultaneously become dislodged from the intake holes 128. In practice, however, one or more of the discs, plates or stoppers may dislodge prematurely or remain intact after the predefined rupture pressure is reached. If not all of the discs, plates or stoppers are simultaneously dislodged; it may be difficult to generate the requisite rupture pressure in the pump intake 116 with open intake holes 128 to the wellbore 104. As such, the use of a single buckle disc 154 in the fourth intake seal device 150 may provide a more reliable mechanism for ensuring that all of the intake holes 128 are opened simultaneously.

As used herein, the term "intake seal device" broadly refers to each of the various embodiments of the intake seal devices disclosed above and equivalent structures. It will be understood by one of skill in the art that different intake seal devices can be used in combination on a single pump intake 116. For example, it may be desirable to cover a first half of the intake holes 128 with the first intake seal device 132 and a second half of the intake holes 128 with the second intake seal device. In other applications, there may be several rows of intake holes 128, which can be sealed with multiple intake seal devices.

While the electric submersible pumping system 110 is dormant, reservoir fluid is drained from the wellbore 104 through the sliding sleeve 108 in the production tubing 102. As the reservoir fluid is directed up the production tubing 102, solids may settle out of the production stream towards the electric submersible pumping system 110. To discourage the accumulation of solids in the pump assembly 112, it is desirable to isolate the pump assembly 112 from the reservoir fluid in the production tubing while the electric submersible pumping system 112 is dormant.

Figure 8:
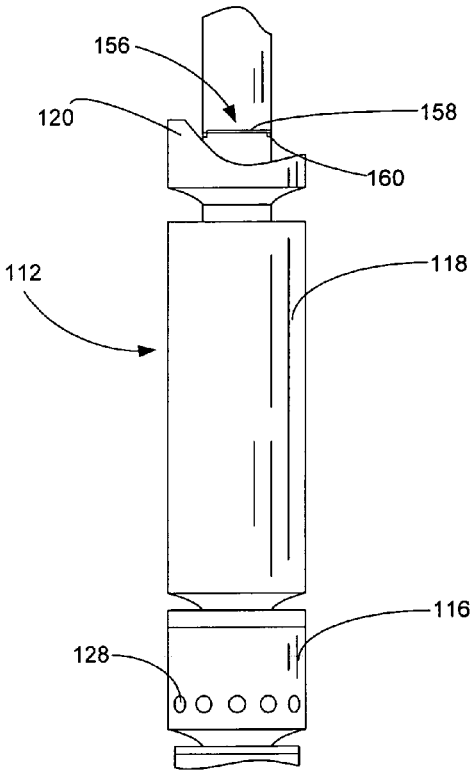
FIG. 8 is an elevational view of the pump assembly with a first embodiment of the outlet seal device.

Turning to FIG. 8, shown therein is the pump assembly 112 with a partial cutaway view of the pump discharge head 120 to illustrate a first outlet seal device 156 constructed in accordance with a preferred embodiment of the present invention. The first outlet seal device 156 preferably includes a conventional flapper valve 158 that prevents the movement of fluid from the production tubing 102 into the pump assembly 114. The flapper valve 158 can be fitted with O-ring seals (not shown) and disposed on a circular shoulder 160 to ensure proper seating.

Figure 9:
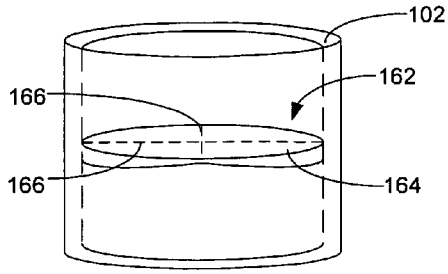
FIG. 9 is an elevational view of the pump discharge head with a second embodiment of the outlet seal device.

Turning to FIG. 9, shown therein is a second outlet seal device 162 constructed in accordance with a yet another preferred embodiment of the present invention. The second outlet seal device 162 preferably includes a perforated rupture disc 164 with perforations 166. The outer diameter of the perforated rupture disc 164 is selected to fit tightly within the inner diameter of the production tubing 102 or pump discharge head 120. To ensure that the perforated rupture disc 164 ruptures properly, it is preferred that the thickness along the periphery of the perforated rupture disc 164 taper to the center of the perforated rupture disc 164.

Figure 10:
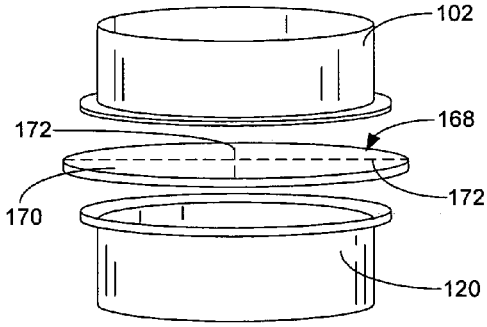
FIG. 10 is an elevational view of the pump discharge head with a third embodiment of the outlet seal device.

Referring to FIG. 10, shown therein is a third outlet seal device 168 constructed in accordance with another preferred embodiment of the present invention. The third outlet seal device 168 includes a perforated rupture plate 170 that includes perforations 172 that are configured to separate under a preset load. The perforated rupture plate 170 is configured to be secured as an intermediate member between the pump discharge head 120 and production tubing 102. As those in the industry will recognize, installing the perforated rupture plate 170 as an intermediate member may facilitate manufacture and replacement. It will be noted that the perforated rupture plate 170 can be successfully installed at any point in the equipment string 100 or production tubing 102 above the pump assembly 112 and below the sliding sleeve 108.

As used herein, the term "outlet seal device" refers to each of the various embodiments of the outlet seal devices disclosed above and equivalent structures. The term "rupture seal" generally refers to any outlet seal device that ruptures when exposed to fluid under sufficient pressure.

It will be understood that different outlet seal devices can be simultaneously used in combination. For example, it may be desirable to position the rupture disc 170 above the flapper valve 158. Such redundancy could provide a more reliable system. It will also be understood that any outlet seal device can be simultaneously used in combination with any of the intake seal devices. It should further be noted that, in some applications, it may be desirable to use only one of the outlet seal device and intake seal device. The outlet seal devices and intake seal devices are capable of independent use.

Figure 11:
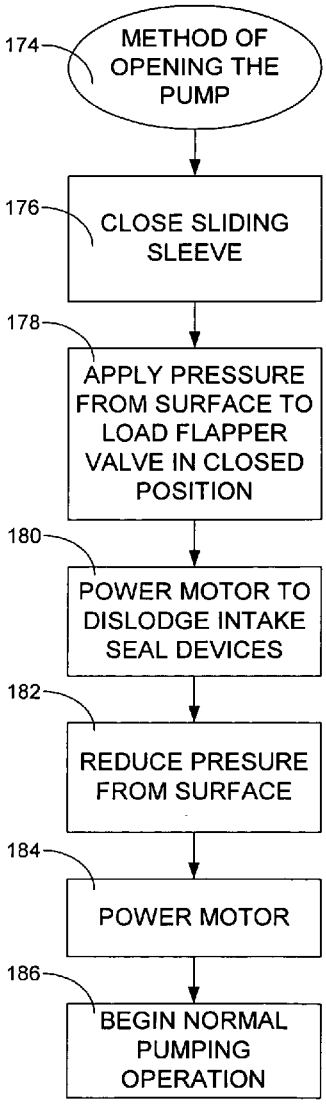
FIG. 11 is a process flow diagram of a preferred method for opening the pump assembly.

Turning now to FIG. 11, shown therein is a flowchart 174 for a preferred method of opening the pump assembly 112 when fitted with any of the first intake devices and the flapper valve 158 of the second outlet seal device 162. When it becomes desirable to bring the electric submersible pumping system 110 online, the sliding sleeve should be closed, at step 176. Next, at step 178, the fluid above the second outlet seal device 162 is pressurized to load the flapper valve 158 in the closed position. A common frac pump, which is a high pressure, high volume pump used in well fracturing operations, is suitable for providing the requisite pressure from the surface.

At step 180, the motor 122 is powered and the pump assembly 112 is activated. The working fluid contained within the pump assembly 112 will be energized, generating an internal pressure sufficient to dislodge the installed intake seal device. For some pump subassemblies 112, it may be desirable to operate the motor 122 in reverse to generate the pressure necessary to dislodge the intake seal device. Next, at step 182, the pressure applied from the surface is reduced to unload the flapper valve 158.

At step 184, the motor is powered in a forward direction causing reservoir fluid to be drawn through the open intake holes 128. The reservoir fluid is then pressurized in the pump assembly 112, thereby forcing the flapper valve 158 into an open position. At step 186, the normal pumping operation begins as reservoir fluid is drawn through the open pump intake 116, pressurized in the pump housing 118 and pushed into the production tubing 102 through the unsealed pump discharge head 120. In this way, the pump assembly 112 can be opened through use of a remote command from the surface.

Figure 12:
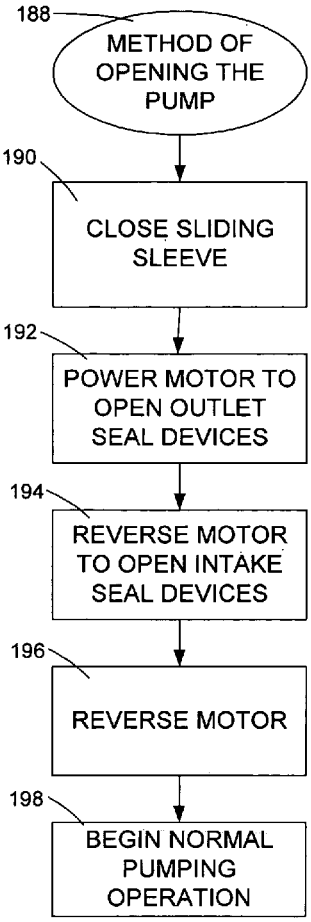
FIG. 12 is a process flow diagram of a second preferred method for opening the pump assembly.

FIG. 12 is a flowchart for a second preferred method 188 of opening the pump assembly 112 when fitted with any of the outlet seal devices that employ a rupture seal. The second preferred method 188 begins at step 190 by closing the sliding sleeve 108. Next, the motor 122 is powered in a forward direction to pressurize the working fluid in the pump assembly 112 against the rupture seal, at step 192. When the working fluid reaches the rupture pressure, the outlet seal device will rupture, open or become dislodged, thereby placing the pump discharge head 120 in fluid communication with the reservoir fluid in the production tubing 102.

The method continues at step 194 by reversing the motor 122 to pressurize the fluid in the pump assembly 112 against the installed intake seal device. When the preset rupture pressure is reached, the intake seal device will open, rupture or become dislodged, thereby placing the pump intake 116 in fluid communication with the wellbore 104. At step 196, the motor 122 is reversed and the process ends at step 198 as normal pumping operation begins. It is significant that the method 188 does not rely on the generation of fluid pressure from the surface.

Figure 13:
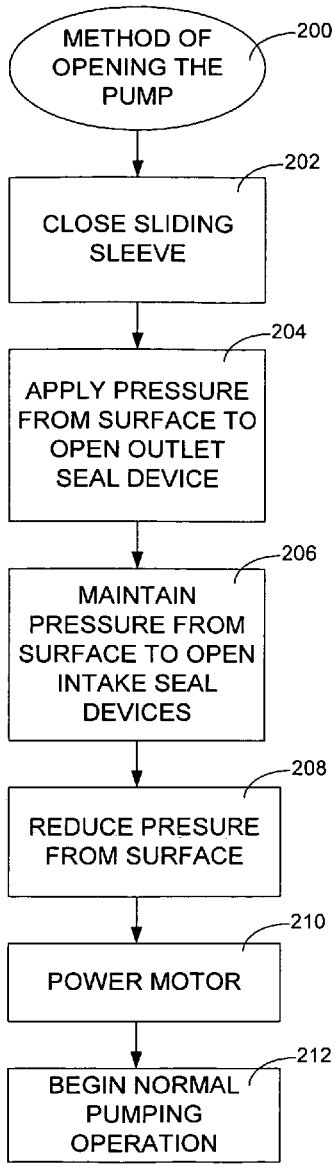
FIG. 13 is a process flow diagram of a third preferred method for opening the pump assembly.

Turning next to FIG. 13, shown therein is another preferred method 200 of opening the pump assembly 112. At step 202, the sliding sleeve 108 is closed. Next, at step 204, the fluid above the second outlet seal device 162 is pressurized to rupture the installed outlet seal device, thereby placing the pump discharge head 120 in fluid communication with the production tubing 102. A common frac pump, which is a high pressure, high volume pump used in well fracturing operations, is suitable for providing the requisite pressure from the surface. It will be understood that any surface pump that generates sufficient pressure and volume can be used with equal success.

At step 206, the pressurized fluid enters the pump housing 118 and pump intake 116. When the pressure in the pump intake reaches the preset rupture pressure, the installed intake seal device will open, rupture or dislodge, thereby placing the pump intake 116 in fluid communication with the wellbore 104. At step 208, the surface pressure is reduced and the motor 122 is powered at 210. The process ends at step 212 as the normal pumping operation begins.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed in the spirit of the invention disclosed and as shown in the drawings and defined in the appended claims.

What is claimed is:

1. An electric submersible pumping system having a pump assembly connected to a motor, the pump assembly comprising:

a pump intake having an intake hole;

a pump housing connected to the pump intake;

a pump discharge head connected to the pump housing; and an intake seal device connected to the pump intake, wherein the seal device is permanently removed from the pump intake prior to the initial use of the pump assembly.

2. The electric submersible pumping system of claim 1, wherein the intake seal device is configured for removal by remote command.

3. The electric submersible pumping system of claim 1, wherein the intake seal device comprises:

a cylindrical band; and at least one rupture disc connected to the cylindrical band and positioned adjacent the intake hole and wherein the rupture disc is manufactured to rupture or dislodge from the cylindrical band at a preset pressure.

4. The electric submersible pumping system of claim 1, wherein the intake seal device comprises a rupture plate that is attached to the pump intake adjacent the intake hole and wherein the rupture plate is manufactured to rupture or dislodge from the pump intake at a preset pressure.

5. The electric submersible pumping system of claim 1, wherein the intake seal device comprises a stopper that is configured to fit tightly within the intake hole and wherein the stopper is manufactured to dislodge from the intake hole at a preset pressure.

6. The electric submersible pumping system of claim 1, wherein the intake seal device comprises a belt seal connected to a buckle disc that is positioned adjacent to the intake hole and wherein the buckle disc is manufactured to rupture or dislodge from the pump intake at a preset pressure.

7. The electric submersible pumping system of claim 1, wherein the pump assembly comprises a catch collar positioned below the intake hole and wherein the catch collar is configured to catch the intake seal device once dislodged from the pump intake.

8. The electric submersible pumping system of claim 1, wherein the pump assembly further comprises an outlet seal device to seal the pump discharge head when the pump assembly is not operating.

9. The electric submersible pumping system of claim 8, wherein the outlet seal device is configured for removal by remote command.

10. The electric submersible pumping system of claim 8, wherein the outlet seal device comprises a flapper valve that seats on a shoulder.

11. The electric submersible pumping system of claim 8, wherein the outlet seal device comprises a perforated rupture disc disposed within the inner diameter of the pump discharge head and wherein the perforated rupture disc is manufactured to rupture at a preset pressure.

12. The electric submersible pumping system of claim 8, wherein the pump discharge head is proximate to production tubing and wherein the seal device comprises a perforated rupture plate that is secured as an intermediate between the pump discharge head and the production tubing.

13. A method of recovering petroleum from a reservoir through a well with a submersible pump assembly, comprising the steps of:

installing an intake seal device on the submersible pump assembly;

connecting the submersible pump assembly to production tubing;

installing the production tubing and submersible pump assembly in the well;

permanently removing the intake seal device from the submersible pump assembly; and activating the submersible pump assembly to forcibly drain the petroleum from the reservoir.

14. The method of claim 13, wherein the method further comprises installing an outlet seal device on the submersible pump assembly.

15. The method of claim 14, wherein the outlet seal device is a flapper valve and the step of permanently removing the intake seal device from the submersible pump assembly comprises:

applying pressure to load the flapper valve in a closed position;

activating the submersible pump assembly to generate an internal pressure sufficient to unseal the intake sealing device; and reducing the application of pressure from the surface to allow the internal pressure to open the flapper valve.

16. The method of claim 14, wherein the outlet seal device includes a rupture seal and the step of unsealing the submersible pump assembly comprises:

activating the submersible pump assembly in a forward direction to generate an internal pressure sufficient to open the outlet seal device; and reversing the direction of the submersible pump assembly to generate an internal pressure sufficient to open the intake seal device.

17. The method of claim 14, wherein the outlet seal device includes a rupture seal and the step of unsealing the submersible pump assembly comprises:

applying pressure from the surface to open the outlet seal device; and maintaining the pressure applied from the surface to open the intake seal device.

18. The method of claim 13, further comprising the step of holding the submersible pump assembly in a dormant state before unsealing the submersible pump assembly.

19. An electric submersible pumping system comprising:

a motor assembly;

a pump assembly connected to the motor assembly, wherein the pump assembly includes a pump intake and a pump discharge head;

means for sealing the pump intake; and means for permanently removing the sealing means from the pump intake.

20. The electric submersible pumping system of claim 19, further comprising means for sealing the pump discharge head.

* * * * *

UNITED STATES PATENT AND TRADEMARK OFFICE

CERTIFICATE OF CORRECTION

PATENT NO. : 7,086,473 B1
APPLICATION NO. : 10/234793
DATED : August 8, 2006
INVENTOR(S) : Yasser Khan Bangash It is certified that error appears in the above-identified patent and that said Letters Patent is hereby corrected as shown below:

Item [56]
In the Related U.S. Application Data, replace “60/322,327” with --60/322,237--
Item [56]
In References Cited, add --3,994,338* 11/1976 Hix…...166/105--

In the drawings, Sheet 4, figures 11 and 12, reference numeral 182 and 208, replace “presure” with --pressure'--

Column 2, line 47, replace “a equipment” with --an equipment--

Signed and Sealed this

Twelfth Day of December, 2006

JON W. DUDAS
*Director of the United States Patent and Trademark Office*